US005570913A

United States Patent [19]

Puric

[11] Patent Number: 5,570,913

[45] Date of Patent: Nov. 5, 1996

[54] INDEPENDENT DUAL DEADBOLT LOCKING MECHANISM

[76] Inventor: Marino Puric, 4819 Birchwood, Skokie, Ill. 60077

[21] Appl. No.: 386,689

[22] Filed: Feb. 10, 1995

Related U.S. Application Data

[63] Continuation-in-part of Ser. No. 248,438, May 24, 1994, Pat. No. 5,472,246.

[51] Int. Cl.[6] ..... E05C 1/06

[52] U.S. Cl. ..... 292/36; 292/37; 292/42; 70/418

[58] Field of Search ..... 292/3, 36, 37, 292/35, 40, 42, 156, 158, 139, 359, 32, DIG. 62, DIG. 18; 70/120, 418

[56] References Cited

U.S. PATENT DOCUMENTS

| | | | |
|---|---|---|---|
| 724,521 | 4/1903 | Teeter | 292/37 X |
| 993,235 | 5/1911 | Friedman | 292/37 |
| 1,460,166 | 6/1923 | McArthur | 292/37 |
| 1,635,714 | 7/1927 | Hoffman | 292/37 X |
| 1,909,697 | 5/1933 | MacBeth et al. | 292/359 |
| 2,473,065 | 6/1949 | Miller | 292/37 |
| 3,633,389 | 1/1972 | Horgan, Jr. | 70/120 |
| 3,699,788 | 10/1972 | Gerlach | 292/139 X |
| 4,037,440 | 7/1977 | Shabtai et al. | 70/120 |
| 4,142,747 | 3/1979 | Beck et al. | 292/40 X |
| 5,077,992 | 1/1992 | Su | 292/36 X |

FOREIGN PATENT DOCUMENTS

| | | | |
|---|---|---|---|
| 393791 | 1/1921 | Germany | 70/120 |

*Primary Examiner*—Rodney M. Lindsey
*Attorney, Agent, or Firm*—Lee, Mann, Smith, McWilliams, Sweeney & Ohlson

[57] ABSTRACT

An independent dual deadbolt locking mechanism for securing doors, windows or the like. The dual locking mechanism has a single pivot key that acts to place two deadbolt locks in either a locked or unlocked position simultaneously. The deadbolts may be oriented at various angles to one another. Typically, the deadbolts are oriented at a 90 degree angle from one another, with one deadbolt locking into the side frame of a door, and the other locking into the upper door frame or floor. The mechanical arrangements of the locking mechanism allows one deadbolt to be broken or forced into an unlocked position without affecting or unlocking the other independent deadbolt.

17 Claims, 11 Drawing Sheets

INDEPENDENT DUAL DEADBOLT LOCKING MECHANISM

RELATED APPLICATION

This application is a continuation-in-part of U.S. patent application Ser. No. 08/248,438, filed May 24, 1994, now U.S. Pat. No. 5,472,246.

FIELD OF THE INVENTION

This invention relates generally to a locking mechanism for locking and unlocking doors or similar structures, and particularly to a locking mechanism having dual deadbolt locks which are protected from being simultaneously forcibly opened.

BACKGROUND OF THE INVENTION

Standard deadbolt door locks are designed to project a single sliding bolt into a socket of a casing of a door. This single sliding bolt construction provides only limited security for doors and windows since there is locking only at one location.

Locking mechanisms have been proposed which have multiple deadbolt locking capabilities for added security. U.S. Pat. No. 1,513,835 discloses a locking device for windows that has a pair of locking bolts movable at fight angles to each other. The mechanism of this patent, however, transmits motion from one locking bolt to the other.

U.S. Pat. No. 2,125,227 discloses a locking device for a door which projects a sliding bolt into the side casing of a door and also projects a pair of pins upwardly and downwardly into the lintel and sill of a door. The pins are not independently held in place once being locked.

Although prior multiple locking mechanisms exist, such mechanisms have many of the same failings that single locking mechanisms have. Single deadbolt locks may be forcibly unlocked by forcing the deadbolt back into its chamber with a crow bar or similar object. Prior multiple deadbolt locking devices are constructed where each deadbolt is always in an interlocking engagement with another deadbolt so whenever there is motion by one deadbolt, an equivalent motion is transferred to the other deadbolt. This transferring of motion is present even when one deadbolt is forced back into its chamber or unlocked position. By forcibly unlocking one deadbolt, the other interlocking deadbolt becomes unlocked as well.

To fully take advantage of a multiple deadbolt locking device, there is a need for a dual locking device that has deadbolts which may be maintained in a locked position independently, regardless of whether one of the deadbolts becomes forcibly unlocked.

SUMMARY OF THE INVENTION

In accordance with the present invention, an independent dual locking mechanism is provided that is ideally suited for securing doors, windows and the like. The locking mechanism, according to the present invention, has all the advantages of dual locking deadbolt locks over single deadbolt locking mechanisms, and more importantly, the present invention has two deadbolts, that when locked, act independently of each other. Therefore, if one lock is forcibly broken or unlocked, the other remains in a locked position.

The dual locking mechanism also has the capability of being adjustable. While preferably the dual deadbolts may be at right angles to each other for interlocking engagement with a socket in the casing of a door and an upper door sash or floor, they also may be oriented with one deadbolt in an upper door sash and the other in the floor. The deadbolts of the locking mechanism may also be adjusted to all other angles between 180 and 0 degrees.

Accordingly, the invention relates to an independent dual locking mechanism comprising two deadbolts, separate means for linking each deadbolt to a single location, actuating means at the single location which is connected to the separate means and used for locking and unlocking the two deadbolts simultaneously while only using a single method of activation, and a means for preventing one deadbolt from becoming unlocked when the other deadbolt is forcibly unlocked or broken.

BRIEF DESCRIPTION OF THE DRAWINGS

The invention is described in greater detail in the following description of examples embodying the best mode of the invention, taken in conjunction with the drawing figures, in which.

DETAILED DESCRIPTION OF THE INVENTION

Figure 1:
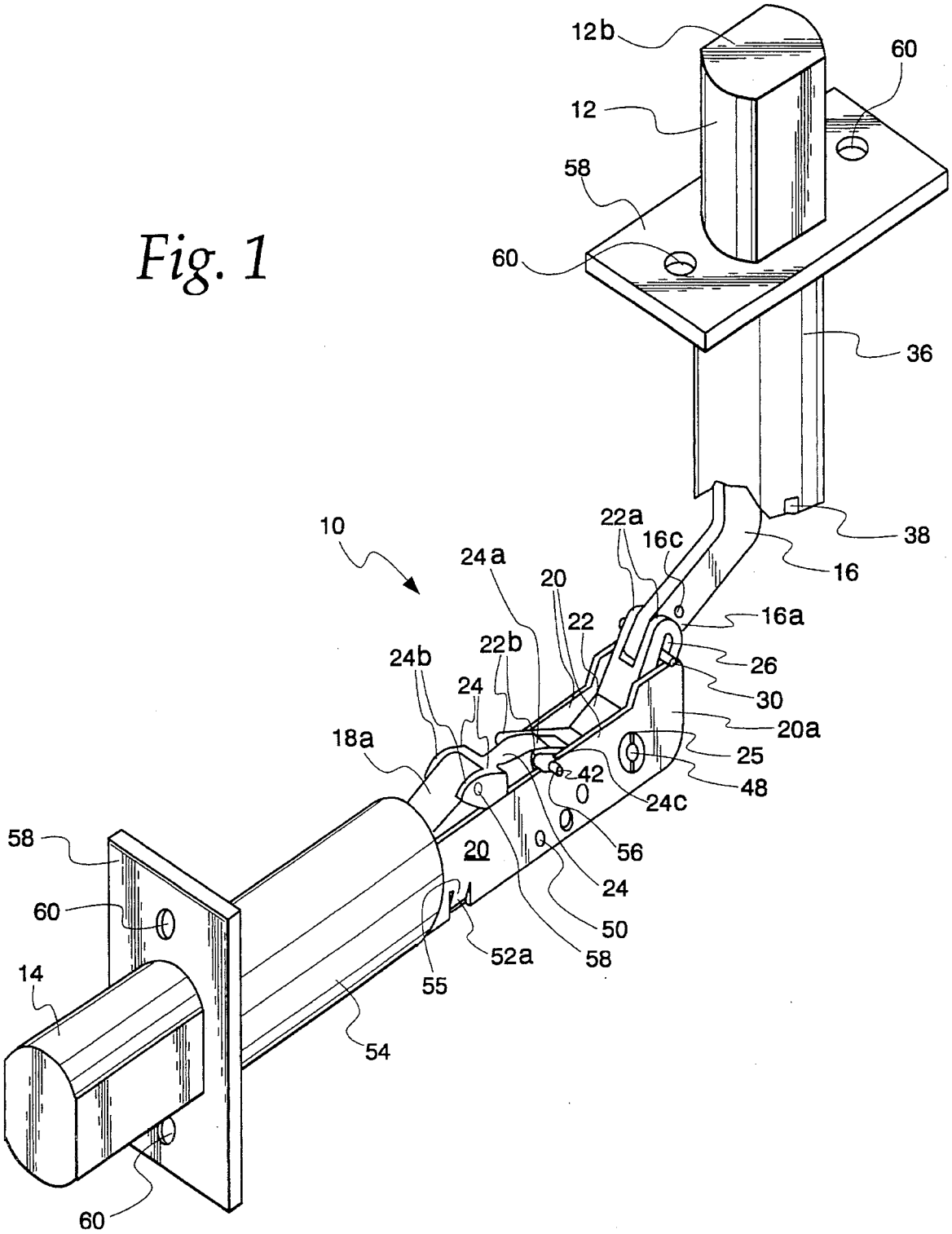
FIG. 1 is a perspective view of the first embodiment showing the dual locking mechanism according to the invention with dual deadbolts disposed at right angles to one another, and with both deadbolts extended in the locked position.

Referring now to the drawings in more detail, reference numeral 10 generally designates an independent dual deadbolt locking mechanism constructed in accordance with a preferred first and second embodiment of the present invention. In the first embodiment, the mechanism 10 includes a first and second deadbolt 12 and 14, first and second actuators 16 and 18, a housing 20, a main pivot element 22, and a dual pivot link 24.

The main pivot element 22 pivots about a central pivot 25 located at a first end 20*a* of the housing 20. The main pivot element 22 has first extending arms 22*a* and second extending arms 22*b*. The arms 22*a* include slots 26, and arms 22*b* include slots 28. The first actuator 16 has a first end 16*a* and a second end 16*b*. A series of holes 16*c* are located in the first end 16*a*. The first end 16*a* fits between the arms 22*a* of the main pivot element 22 so that one of the holes 16*c* of the first actuator 16 is positioned between slots 26. A pin 30 is secured in the one hole 16*c* and through the slots 26 to allow the first actuator 16 to pivot about the pin 30 between the arms 22*a*.

Figure 2:
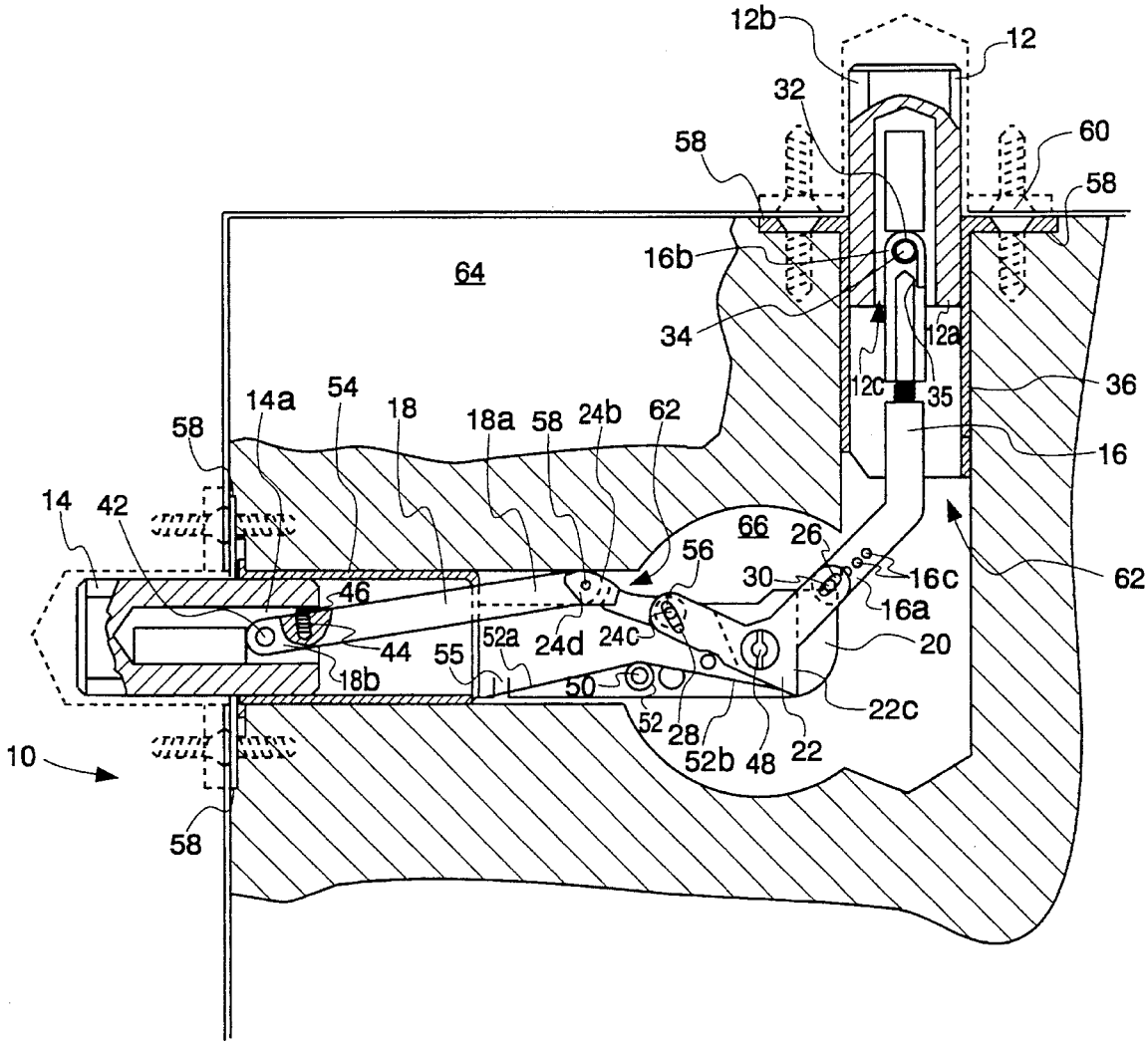
FIG. 2 is an elevational view of the first embodiment of the dual locking mechanism, partially is section to show detail, and shown mounted in a door with the deadbolts extended into the locked position.

The first deadbolt 12, as best shown in FIG. 2, has a first end 12*a* and a second end 12*b*. The first end 12*a* has a hollowed opening 12*c*. The second end 16*b* of the first actuator 16 extends into the hollow opening 12*c* of the first deadbolt 12. The second end 16*b* has a hole 32 therethrough. A rod 34 is mounted in first deadbolt 12 in opening 12*c* and extends through hole 32 allowing the second end 16*b* of the first actuator 16 to pivot about rod 34. A spring 35 extends around rod 34 and bears against the end 16*b*, biasing the first end 16*a* of the first actuator 16 in a direction toward the second deadbolt 14, for purposes that will become apparent below.

As seen in FIG. 1, the first deadbolt 12 is slidable within a hollow first deadbolt housing 36. The first deadbolt housing 36 includes a stop 38 which protrudes inwardly to limit travel as the first deadbolt 12 moves longitudinally through the first deadbolt housing 36. The stop 38 also acts as a stop for the mechanism 10 when the deadbolts 12 and 14 are retracted, as described below.

The dual pivot link 24 has opposite ends 24*a* and 24*b*. The end 24*a* has hole 24*c* therethrough and is located between the arms 22*b* of the main pivot element 22. A pin 42 is mounted in the hole 24*c* of the pivot link 24 to the second set of arms 22*d* of the main pivot element 22. The pin 42 also extends axially beyond the arms 22*b* sufficiently to contact the housing 20. As seen on FIGS. 1 and 2, a pair of notches 56 are located on both sides of the housing 20 to receive the extended pin 42 when the locking mechanism 10 is in a locked position.

The second actuator 18 has a first end 18*a* and a second end 18*b*. The first end 18*a* has a hole therethrough. The end 24*b* of the dual pivot link 24 consists of two arms 24*d*. A hole extends through each arm 24*d*. The first end 18*a* of the second actuator 18 is positioned between the arms 24*d* of the dual pivot link 24 to the end 18*a* of the second actuator 18.

The second deadbolt 14 is slidable mounted inside a hollow second deadbolt housing 54. The housing 20, as best shown in FIG. 1, is secured to the second deadbolt housing 54. The second end 18*b* of the second actuator 18 extends inside an open end 14*a* of the second deadbolt 14. The second end 18*b* has a hole therethrough. A rod 42 is mounted through the deadbolt 14 inside the open end 14*a* and extends through the hole in end 18*b*, thereby pivotally connecting the second end 18*b* of the second actuator 18 in the second deadbolt 14.

As seen in FIG. 2, the second end 18*b* of the second actuator 18 has a bore 44 that holds a spring 46. The spring 46 biases against and inside the open end 14*a* of the second deadbolt 14 and the bottom of the bore 44, thereby biasing the second actuator 18 outwardly (to the left as seen in FIGS. 2 and 3).

A fixed pivot pin 48 extends through the center pivot 25 of the housing 20. The pivot pin 48 also extends through the center of the main pivot element 22 and thereby acts to pivotally mount the main pivot element inside the housing 20.

Figure 3:
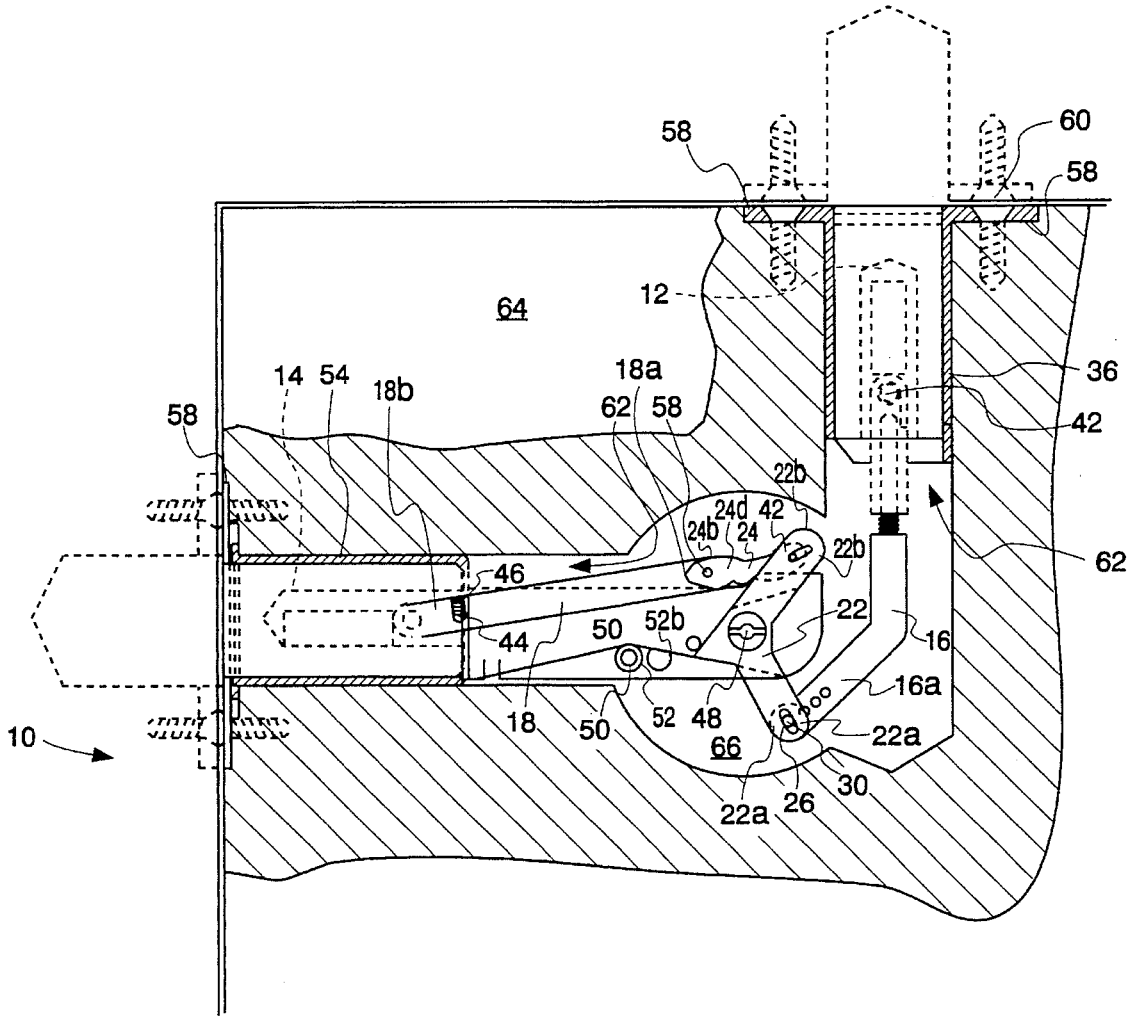
FIG. 3 is an elevational view of the first embodiment similar to FIG. 2, but with the deadbolts retracted to an unlocked position.
Figure 4:
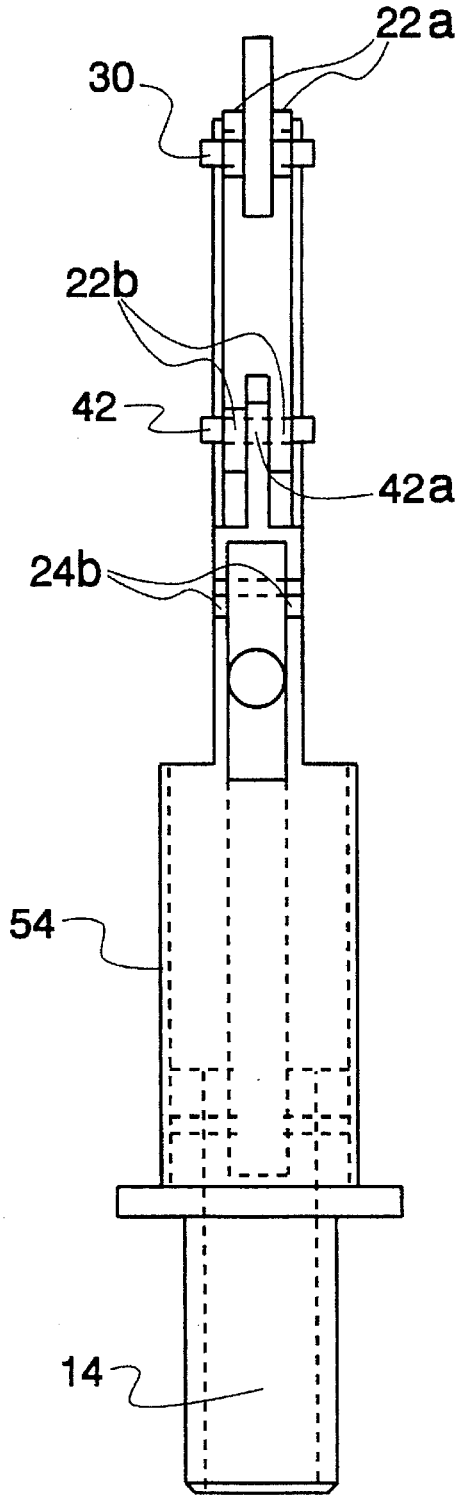
FIG. 4 is a plan view of the first embodiment showing one of the deadbolts in an extended locked position and illustrating its attached locking mechanism.

FIGS. 2 and 3 show a rod 50 mounted in the housing 20. A spring 52 is wrapped around rod 50. The spring 52 has a first arm 52*a* extending beneath a stop 55 located in the housing 20. A second spring arm 52*b* extends against and beneath an angled elbow 22*c* of the main pivot element 22 when the locking mechanism is in the unlocked position or the locked position.

Both first and second deadbolt housings 36 and 54 include a pair of mounting plates 58. The mounting plates 58 am shaped to orient and guide the deadbolts 12 and 14, and have holes 60 to accommodate mounting of the dual deadbolt locking mechanism to the top, bottom or sides of a door with screws or bolts. As seen in FIGS. 2 and 3, when the dual locking mechanism 10 is mounted in a door 64, them are lateral bores 62 in the door 64 to accommodate the positioning of the dual locking mechanism 10 inside the door 64. Also, there is a through bore 66 located where the lateral bores 62 intersect to accommodate rotation of the main pivot element 22 and for insertion of a key or attachment of a handle or knob to the pivot pin 48 for use in locking and unlocking the dual locking mechanism 10.

In operation, to place the dual deadbolt locking mechanism 10 in a locked position from an unlocked position, the pivot pin 48 is turned counter-clockwise (as seen in FIG. 1 and 2). When the pivot pin 48 is turned in the counter-clockwise direction, the attached main pivot element 22 turns in conjunction with the pivot pin 48. The first extending arms 22*a* rotate with the main pivot element 22 forcing the attached first end 16*a* of the first actuator 16 to move inside the first deadbolt housing 36, which causes the first deadbolt 12 to slide through and partially out of the first deadbolt housing 36 to a locked position. The spring 35 biases the actuator end 16*a* in the direction of the second deadbolt 14. This biasing of actuator end 16*a* forces the pin 30 to a position adjacent the first end of the housing 20*a* when the pivot pin 48 is completely turned in a counter-clockwise direction as seen in FIGS. 2 and 3. Once the pin 30 is in a position adjacent the first end 20*a*, the first end 20*a* prevents the pin 30 from moving past the first end 20*a*, thereby preventing the deadbolt 12 from sliding back through the first deadbolt housing 36 and unlocking the first deadbolt 12. Only when the pivot pin 48 is turned back in the clockwise direction will the pin 48 rotate from the first end 20*a* and allow unlocking of the first deadbolt 12.

Figure 6:
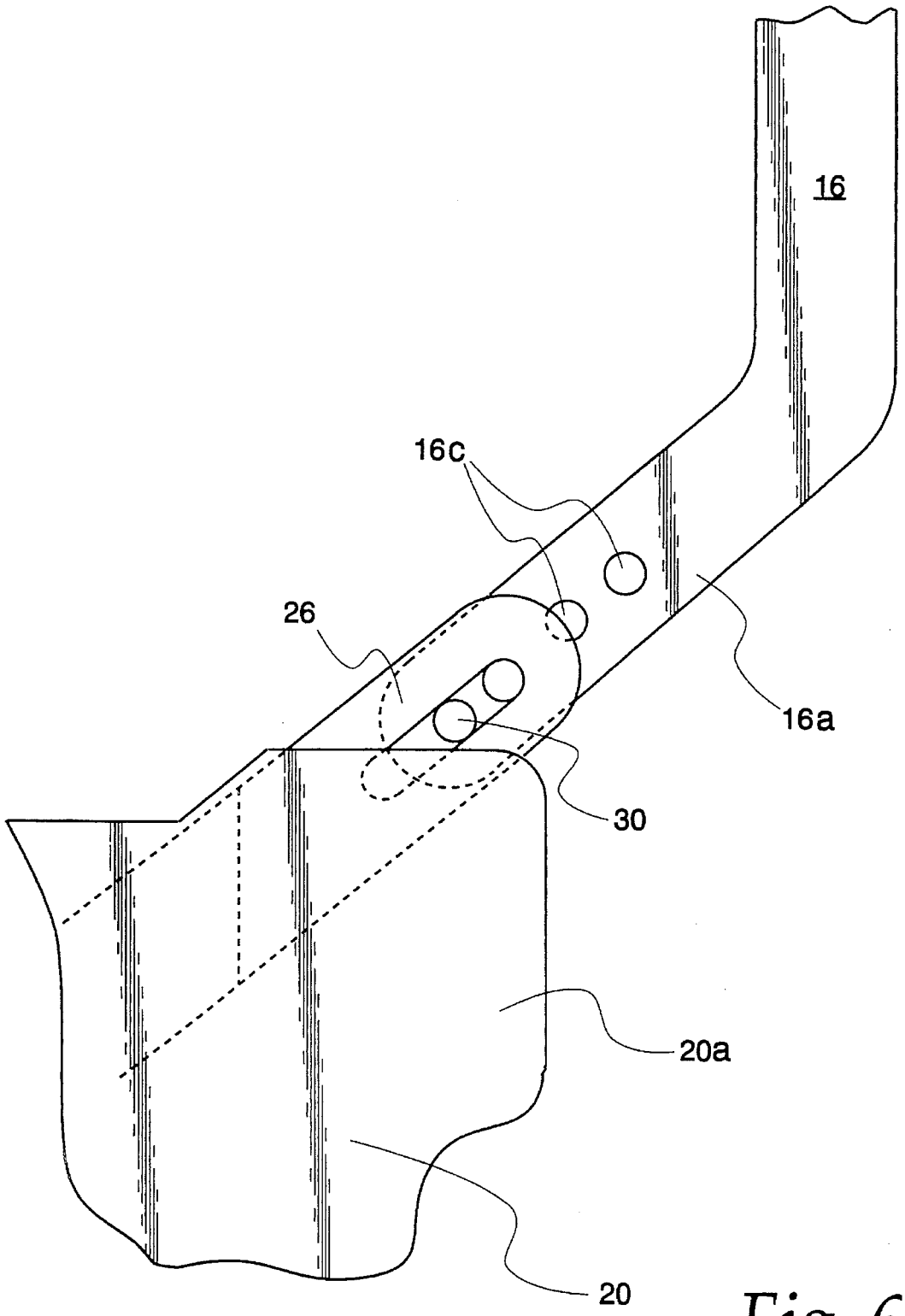
FIG. 6 is an enlarged side elevational view of the first embodiment of the pivotal connection between the main pivot element and the first actuator when the first deadbolt is in a locked position.

When the dual locking mechanism 10 is in a locked position, the slots 26, which hold the pin 30, are positioned to guide the pin 30 against the edges of the side housing 20 when force is exerted axially on the first deadbolt 12, thereby preventing movement and unlocking of the first deadbolt 12 (as better seen in FIG. 6).

Figure 5:
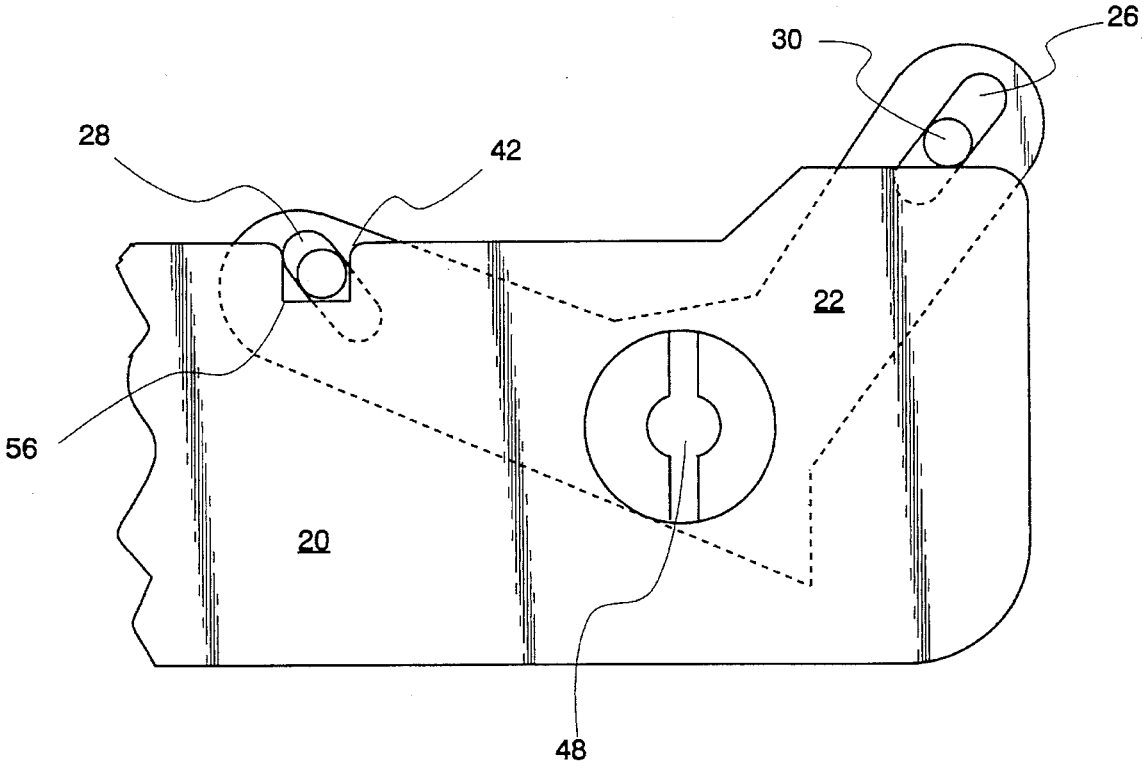
FIG. 5 is an enlarged schematic view the first embodiment of a portion of the invention showing the main pivot element of the dual locking mechanism.

Turning the pivot pin 48 in a counter-clockwise direction also forces the second extending arms 22*b* of the main pivot dement 22 to cause the end 24*b* of the dual pivot link 24 to slide along the edges of the housing 20 over and past both notches 56. The pin 42 abuts against the edges of the housing 20 adjacent to the notches 56. As the main pivot element 22 continues to rotate in the counter-clock wise direction, the pin 42 slides in the slots 28, thereby moving past the point where the pin 42 initially abuts against the edges of the housing, and moves into the notches 56, thereby locking the interconnected second deadbolt 14 in the locked position (as better seen in FIG. 5).

If a large enough force is exerted axially against the first deadbolt 12 to cause either the rod 34, the first actuator 16, or the pin 30 to break, the locking of the second deadbolt 14 would be unaffected since the pin 42 would still be in the notches 56, thereby keeping the second deadbolt 14 in a locked position. Likewise, if a large enough force is exerted axially against, the second deadbolt 14 to cause either the pin 42 or the pin 58 to break, the locking of the first deadbolt 12 would be unaffected since the pin 30 would still abut against the edge 20*a*, preventing axial movement of the first deadbolt 12 and thereby preventing the first deadbolt 12 from moving into an unlocked position.

In a second embodiment, as seen in FIGS. 7 through 14, the mechanism 70 includes first and second deadbolts 72 and 74, first and second actuators 76 and 78, a main housing 80, a housing 82 for the first deadbolt 72, and a main pivot element 84.

Figure 14:
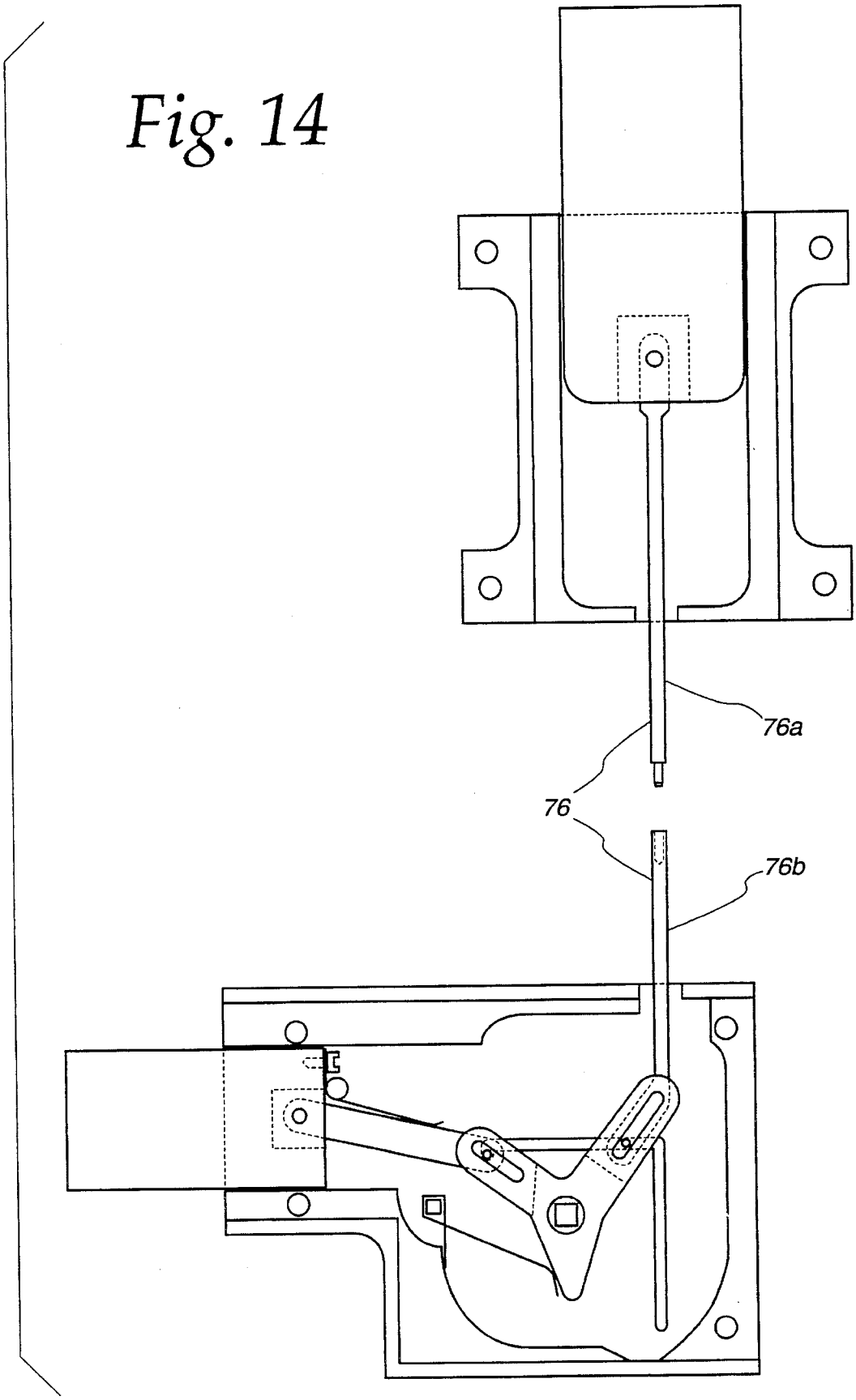
FIG. 14 is a plan view of the second embodiment of the dual locking mechanism showing a separable two-piece actuator for the first deadbolt.

The main pivot element 84 pivots about a central pivot point 86 within the housing 80. The main pivot element 84 includes a pivot pin 134, first extending and spaced apart arms 84*a*, second extending and spaced apart arms 84*b*, and an extending section 84*c*. The arms 84*a* include slots 90, and arms 84*b* include slots 92. The housing 80 has an L-shaped slot 80*a* therein having grooves 80*b* and 80*c*. Groove 80*c* includes an end notch 80*d* therein. The first actuator 76 may include a first link 76*a* and a second link 76*b* (FIG. 14). A hole 94 is located in the first link 76*a*. The first link 76*a* fits between the arms 84*a* of the main pivot element 84 so that hole 94 of the first actuator 76 is positioned between slots 90. A pin 92 extends through hole 94 and slots 90 to create a sliding pivotal connection between arms 84*a* and link 76*a* of the first actuator. The pin 90 also extends sufficiently to slide within the grooves 80*b* and 80*c* of the L-shaped slot 80*a*.

As seen in FIGS. 8 and 11–13, the first deadbolt 72 has a cavity 72*a* therein with holes 102 extending through the first deadbolt 72 to the cavity 72*a*. A connecting pin 100 extends through a hole in the second link 76*b* of the first actuator 76 and through the holes 102 to make a pivotal connection between the first deadbolt 72 and the first actuator 76.

Figure 7:
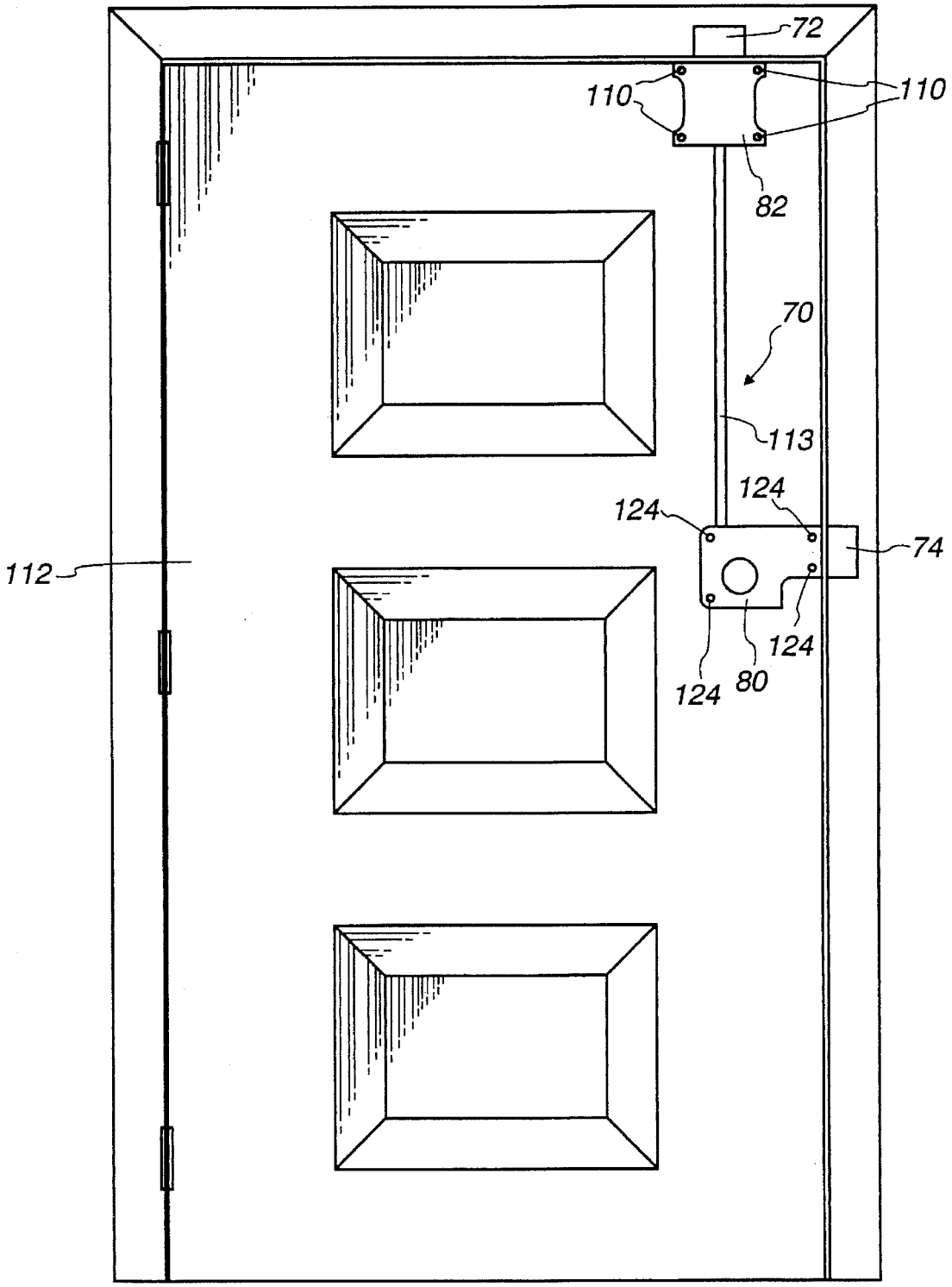
FIG. 7 is a plan view of a door having the second embodiment of the dual locking mechanism with the first deadbolt in an extended locked position in the upper sash of the door and the second deadbolt in an extended locked position in the side casing of the door.

The first deadbolt housing 82 has an internal cavity 104 therein. The first deadbolt 72 is positioned within the cavity 104 and is longitudinally slidably movable within the cavity 104. A cover 106 fits over cavity 104 to enclose the first deadbolt 72 within the first deadbolt housing 82. The cover 106 includes a groove 108 therein for accommodating and guiding the pin 100 when pin 100 moves longitudinally within the first deadbolt housing 82. The first deadbolt housing 82 also includes mounting holes 110 for mounting the housing 82 to the surface of a door 112 as seen in FIG. 7. The first actuator 76 is enclosed by a protective sleeve 113 that is connected between the main housing 80 and the first deadbolt housing 82.

The second actuator 78 has a first end 78*a* and a second end 78*b*. A hole 96 is located in the first end 78*a*. The first end 78*a* fits between the arms 84*b* of the main pivot element 84. A pin 98 extends through hole 96 and slots 92 to create a sliding pivotal connection between arms 84*b* and end 78*a* of the second actuator. The pin 98 is extended into and slides within the groove 84*b* of L-shaped slot 80*a*.

Figure 8:
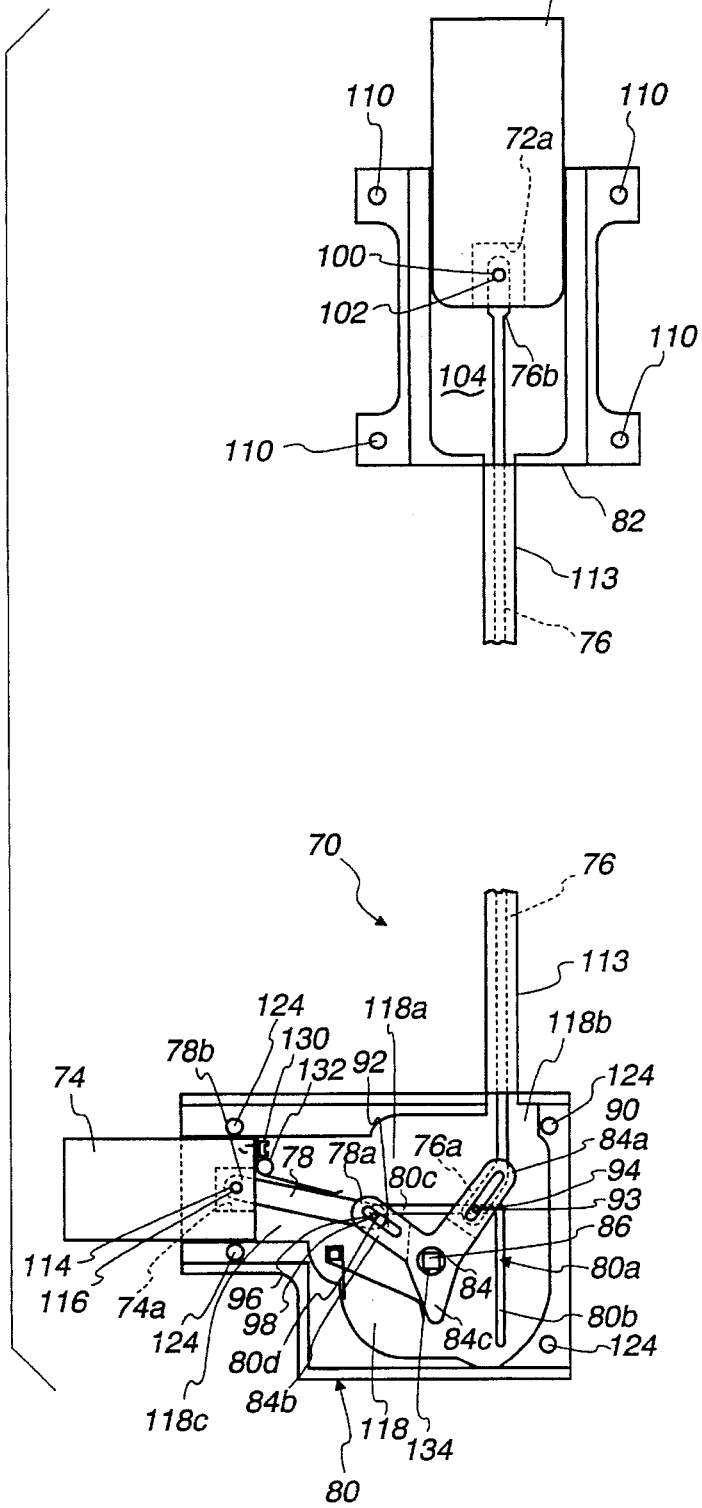
FIG. 8 is a plan view of the second embodiment of the dual locking mechanism with the covers removed from the main housing and first deadbolt housing, and showing the first and second deadbolts extended to locked positions.
Figure 9:
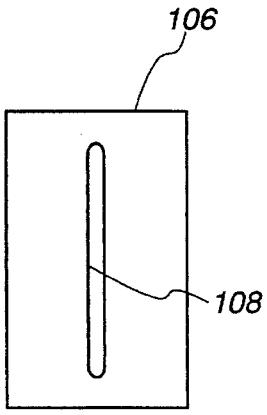
FIG. 9 is a plan view of the housing cover for the main housing of the second embodiment.
Figure 10:
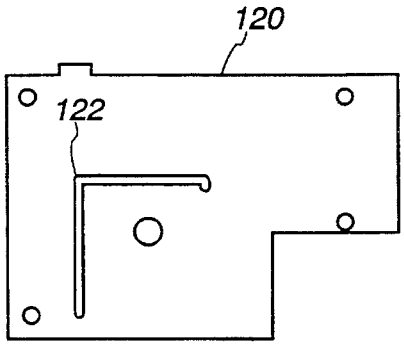
FIG. 10 is a plan view of the housing cover for one of the deadbolts of the second embodiment.

As seen in FIG. 8, the second deadbolt 74 has a cavity 74*a* therein with holes 114 extending through the second deadbolt 74 to the cavity 74*a*. A pin 116 extends through a hole in the second end 78*b* of the second actuator 78 and through holes 114 to make a pivotal connection between the second deadbolt 74 and the second actuator 78.

Figure 11:
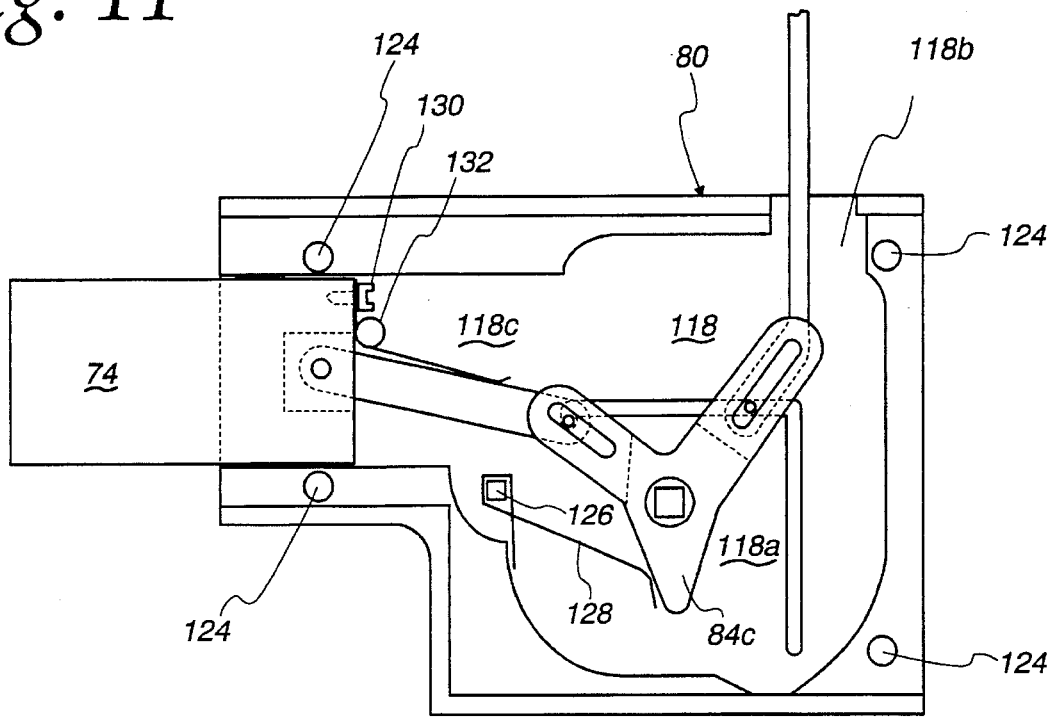
FIG. 11 is an enlarged plan view of the second embodiment of the dual locking mechanism with the cover removed from the main housing showing the second deadbolt in an extended locked position.
Figure 12:
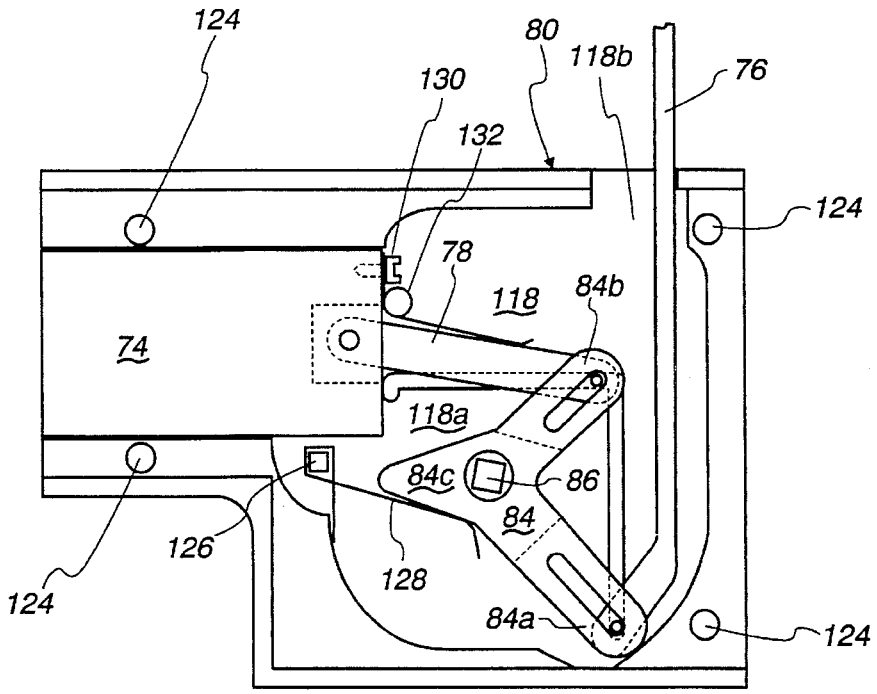
FIG. 12 is an enlarged plan view similar to FIG. 11, but showing the second deadbolt in a retracted unlocked position.
Figure 13:
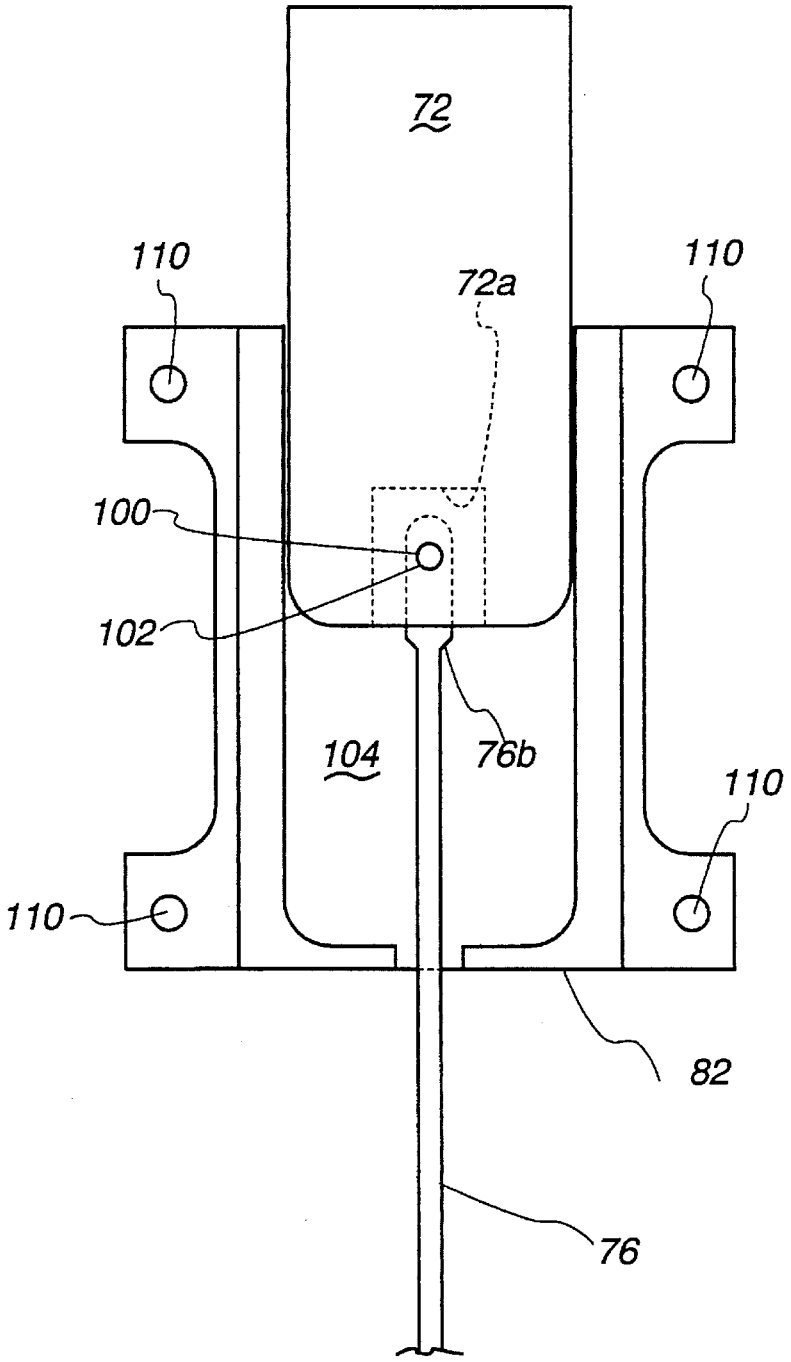
FIG. 13 is an enlarged plan view of the second embodiment of the dual locking mechanism with the cover removed from the first deadbolt housing and showing the first deadbolt in an extended locked position.

As seen in FIGS. 8, 11 and 12, the housing 80 has a cavity 118 therein. The cavity 118 has a section 118*a* to accommodate the rotation of main pivot element 84 about central pivot 86, a section 118*b* to accommodate the first actuator 76, and a section 118*c* to accommodate the second actuator 78 and slidable movement of the second deadbolt 74 within. The second deadbolt 74 is positioned within the cavity 118 and is slidably movable within the cavity 118*c*. A cover 120 fits over the cavity 118 to enclose the main pivot element 84, second actuator 78 and second deadbolt 74 within the housing 80. The cover 120 includes an L-shaped slot 122 therein, directly corresponding to the slot 80*a*, for accommodating pins 92 and 96 when the pins 92 and 96 move within the grooves 80*b* and 80*c* of the housing. The housing 80 also includes mounting the holes 124 for mounting the housing 80 to the door 112 as seen in FIG. 7.

As better seen in FIG. 11 and 12, the housing 80 includes a peg 126 extending within the cavity 118. A spring element 128 is looped around a peg 126 and biases against the extending portion 84*c* whereby the main pivot dement is biased in a clockwise direction as seen in FIG. 12.

A screw 130 is fastened in the second deadbolt 74. A spring element 132 is secured to the deadbolt 74 by the screw 130. A spring element 132 biases against second actuator 78.

As seen in FIG. 14, the first actuator 76 may be provided exist as separable parts 76*a* and 76*b* for easy disassembly of the mechanism 70. This construction allows for attaching or detaching of either the housing 80 or the first deadbolt housing 82 to or from a door 112 without having to attach or detach the other at the same time.

In operation, to place the dual deadbolt locking mechanism 70 in a locked position from an unlocked position, the pivot pin 134 is turned counter-clockwise (as seen in FIG. 8). When the pivot pin 134 is turned in the counter-clockwise direction, the main pivot element 84 rotates about and in conjunction with pivot pin 134. The first extending arms 84*a* rotate with the main pivot element 84 causing the pin 92 to slide upwardly within the groove 80*b* (and similarly within the slot 122) to a position in the groove 80*c* (as seen in FIGS. 8, 11, and 12). The movement of the pin 92 within the slot 90 as the pivot element 84 rotates allows the pin 92 to operably slide in the L-shaped slot 80. As the pin 92 moves upwardly along the groove 80*b*, the first actuator 76 is forced upwardly, thereby forcing the first deadbolt 72 out of the first deadbolt housing 82. Also, as the pin 92 slides upwardly along the groove 80*b*, the pin 98 slides to the left (as seen in FIGS. 8, 11, and 12), to the end notch 80*d*. When the pivot 134 is fully turned, the pin 98 is lodged in the end notch 80*d*. At the same time, the pin 92 moves from groove 80*b* to 80*c*, orienting the first deadbolt 72 to a locked position. The first deadbolt 72 cannot be moved back into the first deadbolt housing 82 without turning the main pivot element 84 since the pin 92 is now out of the groove 80*b* and in the groove 80*c*, thereby preventing lateral movement downward. The spring element 132 is biased against the second actuator 78 when the deadbolts 72 and 74 are in a locked position to bias the pin 96 in the end notch 80*d*. It also cannot be moved laterally to the right in FIGS. 8, 10, and 11 without first turning the pivot 134.

Similarly, when the main pivot element 84 is turned counter clockwise, the second deadbolt moves into an extended locked position out of the housing 80. The pin 98 moves along the groove 80*c* as main pivot element is turned counter clockwise, and the attached second actuator 78 pushes the second deadbolt 74 out of the housing 80 to a locked position. The second deadbolt 74 becomes fully locked in position when the pin 96 moves into the end notch 80*d*. It will be evident that the pin 96 cannot move out of the end notch 80*d* and along the groove 80*c* without turning main pivot element 84. The spring element 128 is biased against the extending element 84*c* when the deadbolts 72 and 74 are in the locked position to prevent the main pivot element 84 from rotating if one of the deadbolts 72 and 74 is forced to attempt to move the first and second deadbolts out of their locked positions. The deadbolts 72 and 74 can only be moved out of their locked positions by applying a counter-clockwise rotational force about the pivot 134 against the force of spring element 128 bearing on the main pivot element 84.

To move both deadbolts 72 and 74 from a locked position to an unlocked position, the main pivot element 84 must be turned clockwise to the position shown in FIG. 12. In a fully unlocked position, the pin 92 abuts against the end of the groove 80*b*. The spring element 128 is biased against the extending section 84*c* thereby keeping the main pivot element 84 from rotating counter-clockwise. In this fully unlocked position, the main pivot element 84 can only rotate in a clockwise direction if a rotational force to overcome the force of the spring element 128 is applied to the main pivot element 84 through the pivot pin 134. Of course, the pin 134 can be connected to a lock set hole cylinder or a door knob, in a conventional fashion.

A seen in FIG. 7, the second embodiment of the dual locking mechanism 70 is advantageous in that the main housing 80 and the first deadbolt housing 82 have apertures 124 and 110 therein for mounting to the surface of the outside surface of the door 112, thereby not requiring any bores within the door for accommodating placement of the mechanism 70 within the door.

Various changes can be made to the invention without departing from the spirit thereof or scope of the following claims.

What is claimed is:

1. An independent dual locking mechanism for locking doors and windows, comprising:

a first deadbolt and a second deadbolt;

a main housing;

a main pivot element having a first slot and a second slot, said main pivot element being pivotally mounted in said main housing;

separate means linking said first deadbolt to the first slot and linking said second deadbolt to the second slot;

activating means at main pivot element and connected to said main pivot element for locking and unlocking the first deadbolt and the second deadbolt simultaneously using only one method of activation; and means in said main housing and associated with grooves in said housing for preventing one deadbolt from becoming unlocked when the other interconnected deadbolt is forcibly unlocked or broken.

2. An independent dual locking mechanism as in claim 1, wherein said second deadbolt is slidable within said main housing.

3. An independent dual locking mechanism as in claim 1, wherein said independent dual locking mechanism includes a first deadbolt housing, said first deadbolt being slidable within said first deadbolt housing.

4. An independent dual locking mechanism as in claim 1, wherein said main pivot element includes a first extending arm, said first slot being located within said first extending arm, and said main pivot element further includes a second extending arm, said second slot being located within said second extending arm.

5. An independent dual locking mechanism as in claim 1, wherein said separate means linking said first deadbolt to the first slot and linking said second deadbolt to the second slot includes a first actuator being connected to said first deadbolt, first means pivotally connecting said first actuator to said first slot, and second means pivotally connecting said second slot to a second actuator, said second actuator being connected to said second deadbolt.

6. An independent dual locking mechanism as in claim 5, wherein said independent dual locking mechanism includes a first deadbolt housing, said first deadbolt being slidable in said first deadbolt housing, said independent dual locking mechanism further including a first actuator sleeve extending between said first deadbolt housing and said main housing, said first actuator sleeve enclosing a portion of the first actuator extending between said first deadbolt housing and said main housing therein.

7. An independent dual locking mechanism as in claim 5, wherein said first means pivotally connecting said first actuator to said first slot comprises a first pin extending through said first slot and said first actuator.

8. An independent dual locking mechanism as in claim 7, wherein said main housing includes a first longitudinal groove and a second longitudinal groove, said first pin being located in said second longitudinal groove and out of said first longitudinal groove when said first deadbolt is in an extended locked position, thereby preventing said first pin from moving in a longitudinal direction along said first longitudinal groove and facilitating the locking of said first deadbolt in the extended locked position.

9. An independent dual locking mechanism as in claim 7, wherein said main housing has a first longitudinal groove therein, said first pin being slidably mounted in said first longitudinal groove.

10. An independent dual locking mechanism as in claim 9, wherein said main housing includes a main housing cover, said main housing cover having a first longitudinal cover groove corresponding to said first longitudinal groove, said first pin being concurrently slidably mounted in both said first longitudinal groove and said first longitudinal cover groove.

11. An independent dual locking mechanism as in claim 5, wherein said second means pivotally connecting said second actuator to said second slot comprises a second pin extending through said second slot and said second actuator.

12. An independent dual locking mechanism as in claim 11, wherein said main housing has a second longitudinal groove therein, said second pin being slidably mounted in said second longitudinal groove.

13. An independent dual locking mechanism as in claim 11, wherein said main housing includes a second longitudinal groove, said second longitudinal groove having a longitudinal groove notch, said second pin being located in said second longitudinal groove notch when said second deadbolt is in an extended locked position, said second pin not being movable in a longitudinal direction along said second longitudinal groove when in said groove notch thereby locking said second deadbolt in an extended locked position.

14. An independent dual locking mechanism as in claim 12, wherein said main housing includes a main housing cover, said main housing cover having a second longitudinal cover groove, said second pin being concurrently slidably mounted in both said second longitudinal groove and said second longitudinal cover groove.

15. An independent dual locking mechanism as in claim 5, wherein said first means pivotally connecting said first actuator to said first slot comprises a first pin extending through said first slot and said first actuator, and said second means pivotally connecting said second actuator to said second slot comprises a second pin extending through said second slot and said second actuator.

16. An independent dual locking mechanism as in claim 15, wherein said main housing includes a first longitudinal groove and a second longitudinal groove therein, said first pin being slidably mounted in said first longitudinal groove and said second pin being slidably mounted in said second longitudinal groove.

17. An independent dual locking mechanism as in claim 15, wherein said main housing includes a first longitudinal groove and a second longitudinal groove, said first pin being located in said second longitudinal groove when said first deadbolt is in an extended locked position, said first pin only being movable in a longitudinal direction along said first longitudinal groove thereby locking said first deadbolt in an extended locked position, and further said second longitudinal groove includes a second longitudinal groove notch, said second pin being located in said second longitudinal groove notch when said second deadbolt is in an extended locked position, said second pin not being movable in a longitudinal direction along said second longitudinal groove when in said groove notch thereby locking said second deadbolt in an extended locked position.

* * * * *